US005128584A

United States Patent [19]

Choi

[11] Patent Number: 5,128,584

[45] Date of Patent: Jul. 7, 1992

[54] IMPREGNATED CATHODE

[75] Inventor: Jong-seo Choi, Seoul, Rep. of Korea

[73] Assignee: Samsung Electron Devices Co., Ltd., Kyunggi, Rep. of Korea

[21] Appl. No.: 660,609

[22] Filed: Feb. 27, 1991

[30] Foreign Application Priority Data

Mar. 13, 1990 [KR] Rep. of Korea ..... 90-3337

[51] Int. Cl.[5] ..... H01J 1/28

[52] U.S. Cl. ..... 313/346 DC; 313/270

[58] Field of Search ..... 313/346 DC, 270, 346; 445/50, 51

[56] References Cited

U.S. PATENT DOCUMENTS 2,673,277 3/1954 Lemmens et al. ..... 445/51 X 4,400,648 8/1983 Taguchi et al. ..... 313/346 R 4,982,133 1/1991 Choi ..... 313/346 DC

*Primary Examiner*—Palmer C. DeMeo

*Attorney, Agent, or Firm*—Cushman, Darby & Cushman

[57] ABSTRACT

An impregnated dispenser cathode comprises a porous metal matrix having electron emissive material is impregnated therein and a cup for storing the porous metal matrix and being fixed together with it. The porous metal matrix is secured to the bottom of the cup. The present invention has the advantage of sharply promoting the value of products as it enhances both their life expectancies and the characteristics of large cathode ray tubes while increasing their reliability by greatly improving the defects of the structure and manufacturing method of conventional impregnated dispenser cathodes.

1 Claim, 1 Drawing Sheet

IMPREGNATED CATHODE

FIELD OF THE INVENTION

The present invention relates to an impregnated cathode and the manufacturing method thereof, and particularly to an impregnated cathode and the manufacturing method thereof in which producibility and thermal efficiency are improved.

BACKGROUND OF THE INVENTION

An impregnated dispenser cathode for use in a large projection tube and an extra-large cathode ray tube for an HDTV is manufactured in such a manner that an electron emissive material such as barium calcium aluminate is impregnated into a porous metal matrix of a high melting point. The typical examples of such an impregnated dispenser cathode are disclosed in U.S. Pat. No. 4,165,473 and U.S. Pat. No. 4,400,648. The usual forms of these conventional impregnated dispenser cathodes, as shown in FIG. 1, comprise a porous metal matrix 10 in which electron emissive material is impregnated, a cup 20 for storing it, and a sleeve 30 for supporting and securing the cup 20 at the upper part thereof and also for receiving a heater 40 inside it.

The manufacturing procedure of the conventional impregnated dispenser cathode described above comprises the following steps.

1) A porous metal matrix manufacturing step: a porous metal matrix is obtained by sintering a body consisting of compressed powdery tungsten and molybdenum powder.
2) An impregnating step: while an electron emissive material such as barium calcium aluminate is in contact with the entire surface of the porous metal matrix, the electron emissive material is fused and impregnated into the metal matrix within a hydrogen atmosphere of a vacuum.
3) A residue removing step: the residue which has become stuck to the surface of the porous metal matrix during the impregnating step is removed by shot peening.
4) Parts fixing step: the three parts, i.e., the sleeve, cup, and metal matrix are fixed to one another by a laser welder after the porous metal matrix is put into the cup specially manufactured and inserted in the upper portion of the sleeve.

In the conventional impregnated dispenser cathode manufactured by the above steps, as shown in FIG. 1, the welding is carried out by the beam from a laser welder or resistance welding heat applied to the upper end of the sleeve 30. The three parts are secured to one another simultaneously at one welding point W1. Electron emissive material impregnated into the metal matrix may inadvertently be evaporated in part when the metal matrix melts during this conventional way of welding.

The electron emissive material evaporates because heat energy is applied so intensely that the three parts, sleeve, cup, and metal matrix, are simultaneously fused at the welding point W1. Further, at this time, the sleeve and other parts may be so heavily damaged as to make the end product unusable.

If lower energy is applied to the welding point in order to obviate the above problem, the welding of the three parts is not completely accomplished failing to secure the parts. In particular, if the metal matrix is not completely secured, it is apt to come out of the cup.

In addition, during the residue removing step, the metal matrix becomes excessively abraded when peening particles collide against the entire surface of the metal matrix. As explained above, this full scale shot peening is needed because a residue of electron emissive material is stuck to the entire surface of the porous metal matrix during the impregnating step where the entire surface of the porous metal matrix is in contact with electron emissive material; thereby negatively affecting manufacturing.

SUMMARY OF THE INVENTION

Therefore, it is an object of the invention to provide an impregnated dispenser cathode and the manufacturing method thereof in order to solve the above problems. It is another object of the invention to provide an impregnated cathode and the manufacturing method thereof in which thermal efficiency and durability are improved.

To accomplish the above objects, the impregnated cathode according to the present invention comprises:

a porous metal matrix in which electron emissive material is impregnated;

a cup in which to store the porous matrix, and is characterized in that the porous metal matrix is secured to the bottom of the cup.

The manufacturing method of the impregnated cathode according to the invention is characterized in that the process of impregnating electron emissive material into the porous metal matrix is carried out after the matrix is secured to the cup.

BRIEF DESCRIPTION OF THE DRAWINGS

The above objects and other advantages of the present invention will become more apparent by describing in detail the preferred embodiment of the present invention with reference to the attached drawings in which.

DESCRIPTION OF THE PREFERRED EMBODIMENT

Figure 1:
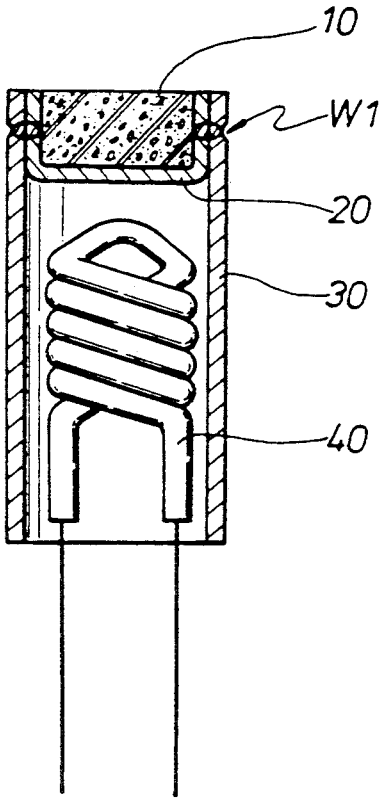
FIG. 1 (PRIOR ART)
FIG. 1 is a schematic cross-section of the conventional impregnated dispenser cathode.
Figure 2:
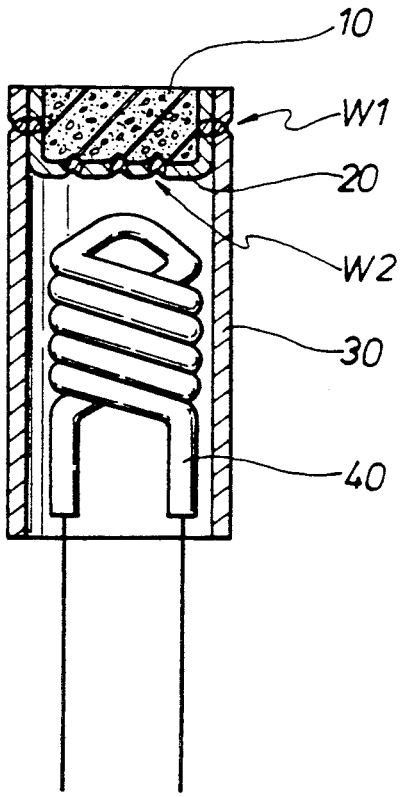
FIG. 2 is a schematic cross-section of the impregnated dispenser cathode according to the present invention.

As shown in FIG. 2, the impregnated dispenser cathode of the present invention comprises a porous metal matrix 10 in which electron emissive material is impregnated, a cup 20 for storing the metal matrix 10, a sleeve 30 for supporting and securing the cup 20 at the upper part thereof and also for receiving a heater 40 therein.

Different from the conventional method, the porous metal matrix 10 and the cup 20 are each fixed through the bottom and the welded portions W2 of the porous metal matrix 10 and the cup 20 have forms which are indented to a predetermined depth up into the matrix itself. The cup 20 and the sleeve 30 are then welded through their sides as in the conventional product.

The manufacturing method of the impregnated dispenser cathode according to the present invention is as follows.

First, a porous metal matrix 10, a cup 20, a sleeve 30, and a heater 40 are manufactured through their respective processes. The porous metal matrix 10 is put into the cup 20 and pressed into the bottom of the cup. The cup 20 and the porous metal matrix 10 are fixed to each other by applying a laser beam to the outer bottom of the cup 20 with a laser welder. The number of the welded points is preferably ranges from 4 to 6. It is also desirable that the welded portions W2 have indented grooves as deep as possible. Then, electron emissive material is impregnated into the porous metal matrix 10 via the usual method. After the completion of the impregnation, the residue stuck to the surface of the porous metal matrix (electron emitting face) is removed by shot peening. The metal matrix and cup assembly is put into the upper portion of the sleeve 30 and welded to the side of the sleeve by a laser welder or a resistance welder.

As described above, the manufacturing method of the present invention including the above described manufacturing steps has the advantages as follow.

First, the cup 20 in which the porous metal matrix 10 is stored and the sleeve 30 are welded to each other through their sides by a small amount of heat, so that evaporation of the electron emissive material impregnated into the porous metal matrix is most effectively suppressed.

Secondly, the impregnation of electron emissive material is carried out after the porous metal 10 is secured to the cup 20, so that the residue after impregnation is stuck only to the exposed upper surface of the porous metal matrix 10. Accordingly, shot peening time for cleaning off the residue becomes shorter and abrasion of the porous metal matrix 10 by shot peening is by far less than the conventional method.

Thirdly, as the porous metal matrix 10 and the cup 20 are pressed tightly together in order to be welded through their bottoms, not only does their adhesion become maximized, but also the indent-type welds define a larger region for absorbing heat from the heater at the bottom.

An impregnated dispenser cathode of the present invention manufactured through the method described above has characteristics as follows.

First, the dispenser cathode has a longer life and electron emission quantities are maintained at a more than required level and electron emission is kept stable over a long period because it has been manufactured in a state that the loss of the electron emissive material is suppressed to the utmost.

Secondly, thermal efficiency comes to a maximum and thanks to this, the electric current of the heater can be lowered. Start-up time of electron emission is by far shorter because the bottom of the cup is partially welded to portions of the porous metal matrix and therefore in close contact with it.

The present invention described above has an advantage to sharply promote the value of products as it enhances both their life expectancies and the characteristics of large cathode ray tubes while increasing reliability due to greatly improving the defects in the structure and manufacturing method of conventional impregnated dispenser cathodes.

What is claimed is:

1. An impregnated dispenser cathode comprising:

a porous metal matrix wherein electron emissive material is impregnated; and a cup for storing said porous metal matrix, said cup being welded at several portions to the bottom of said porous metal matrix after it is stored in said cup whereby said porous metal matrix is secured to the bottom of said cup, and wherein the welded portions formed on the bottom of said cup are indented to increase the entire area of heat absorption.

* * * * *